United States Patent [19]

Klingler

[11] 3,952,753

[45] Apr. 27, 1976

[54] SAFETY ASHTRAY

[76] Inventor: Josef F. Klingler, 1335 Gregory, Wilmette, Ill. 60091

[22] Filed: Feb. 10, 1975

[21] Appl. No.: 548,245

Related U.S. Application Data

[63] Continuation of Ser. No. 409,708, Oct. 25, 1973, abandoned.

[52] U.S. Cl. ..... 131/235 R

[51] Int. Cl.[2] ..... A24F 19/14

[58] Field of Search ..... 131/235 R, 241, 242; 220/60 R, 55 B, 42 D, 69

[56] References Cited

UNITED STATES PATENTS

| | | | |
|---|---|---|---|
| 868,850 | 10/1907 | Eckart | 220/42 D |
| 1,680,668 | 8/1928 | DeBoer | 131/241 X |
| 1,813,467 | 7/1931 | Smith | 131/235 R |
| 2,272,084 | 2/1942 | Clapp | 131/235 R |
| 2,485,228 | 10/1949 | Wood | 131/235 R |
| 2,498,330 | 2/1950 | Block | 131/256 |
| 2,604,100 | 7/1952 | Terry | 131/235 R |
| 2,861,577 | 11/1958 | Glasser | 131/235 R |
| 2,951,487 | 9/1960 | Leone | 131/235 R |
| 3,529,648 | 9/1970 | Bartilson | 220/60 R X |

*Primary Examiner*—Louis G. Mancene
*Assistant Examiner*—John F. Pitrelli
*Attorney, Agent, or Firm*—Wegner, Stellman, McCord, Wiles & Wood

[57] ABSTRACT

A safety ashtray having means for retaining a cigarette with the burning end thereof overlying a central wall and preventing tipping of the cigarette outwardly from the ashtray as a result of further burning of the cigarette. The ashtray includes means for effectively positively snuffing the cigarette spaced inwardly of the outer edge of the ashtray and permits the use of the cigarette holding means to dispose the cigarette for improved snuffing action against the upper surface of the ashtray outwardly of the well.

13 Claims, 5 Drawing Figures

SAFETY ASHTRAY

CROSS-REFERENCE TO RELATED APPLICATIONS

This application comprises a continuation of my copending application Ser. No. 409,708, filed Oct. 25, 1973, now abandoned.

BACKGROUND OF THE INVENTION

1. Field of the Invention

This invention relates to ashtrays.

2. Description of the Prior Art

In one conventional form of ashtray, a grooved surface is provided in the upper portion thereof for supporting a cigarette or the like with the burning ash portion thereof overlying a central well. A problem arises in such conventional ashtrays in that, when the cigarette burns back to the periphery of the wall, the hanging-over portion of the cigarette may tilt downwardly, dropping the burning cigarette onto the table or other surrounding surface and presenting a serious fire hazard. An example of such a structure is that shown in the U.S. Letters Pat. No. 902,511 of Boska et al, wherein separate saddle elements are provided on the peripheral wall.

Other forms of ashtrays have been developed in an effort to avoid this fire hazard problem utilizing cigarette supports disposed within the ash-receiving well. An example of such an ashtray is that of British patent No. 511,212 of Lawley et al.

Another attempted solution to the problem is the provision of an annular space surrounding the central ash-receiving well into which the cigarette may fall after the burning end reaches the upstanding wall of the inner well, as shown in British Pat. No. 535,051 of Edward James Tripp.

SUMMARY OF THE INVENTION

The present invention comprehends an improved safety ashtray provided with pincer means for effectively holding the cigarette with the burning ash portion overlying the ash-receiving well and defining means for urging the burning portion of the cigarette against the upper surface of the upstanding wall of the ashtray to snuff the cigarette.

As a result of the use of the pincer means to permit effective positive engagement of the cigarette with the ashtray upstanding wall surface, this surface may be defined by a thermoset plastic portion of the ashtray while yet effectively providing the desirable snuffing action.

Further, the pincer means retains the cigarette against inadvertent droppng from the ashtray as by vibration or other accidental movement of the ashtray. The pincer means retains the cigarette at a point spaced inwardly from the ash-receiving well a preselected distance to provide the desired above described snuffing action and further defines means to effect an effectively positive snuffing of the burning cigarette in the event that the burning portion is not snuffed by engagement thereof with the upper wall surface.

The upper wall surface defines a segmentally cylindrical channel receiving the lower portion of the cigarette for further improved snuffing action.

The base portion of the ashtray may be formed of a relatively soft, nonscratching material, such as a thermoplastic, permitting the placement of the ashtray safely on wood tabletops, etc., while yet the top portion of the ashtray may be formed of a relatively rigid, hard material, such as a thermoset plastic.

The invention comprehends an improved assembly of the top portion of the ashtray to the base portion including wedge means releasably securing the portions together while yet permitting separate maintenance thereof when desired, or replacement of either portion as desired. As the base portion is separable from the top portion, the base portions may be provided with a number of different designs, advertising information, etc., for interchangeable utilization with the common design top portion.

The wedge means of the present invention more specifically includes a deflectible portion formed integrally with one of the top and base portions of the ashtray adapted to be wedged snugly between the two portions of the ashtray in the assembled relationship thereof, while yet permitting facilitated separation of the portions when desired. In the illustrated embodiment, the wedge means comprises a flange on the relatively soft base portion engaged by a deflecting portion of the base into wedged association therebetween in the assembled relationship of the ashtray top and base portions.

Thus, the safety ashtray of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
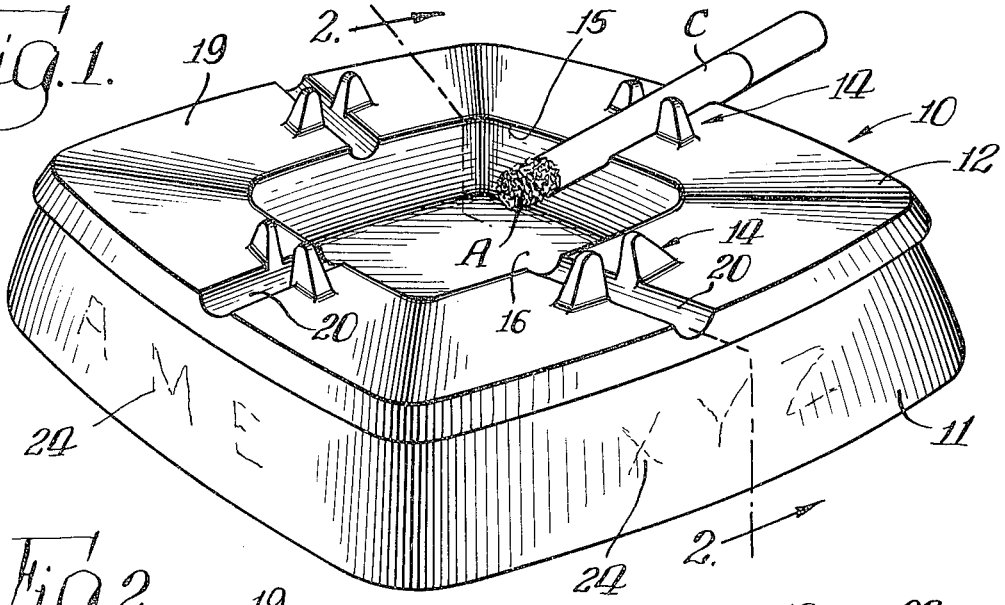
FIG. 1 is a perspective view of a safety ashtray embodying the invention.

In the exemplary embodiment of the invention as shown in the drawing, a safety ashtray generally designated 10 is shown to comprise a base portion 11 and a top portion 12 secured together by a separable securing means generally designated 13. In the illustrated embodiment, the top portion 12 is formed of a relatively hard, heat resistant material, such as a thermoset plastic, whereas the base portion 11 is preferably formed of a relatively softer, more flexible material, such as a thermoplastic material. Base portion 11 is adapted to be set on relatively damage-susceptible surfaces, such as tabletops and the like, without damaging the same, and the ashtray includes safety means for effectively preventing heat damage to the supporting surface as from cigarettes and the like falling from the ashtray thereonto.

Figure 2:
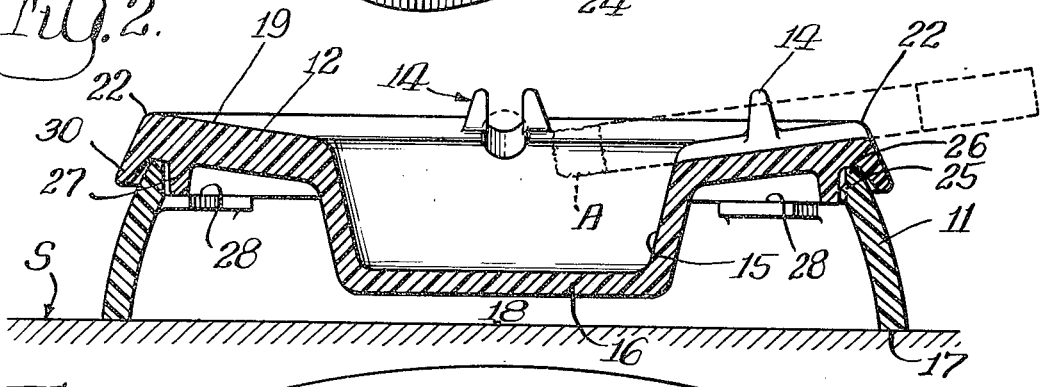
FIG. 2 is a vertical section thereof taken substantially along the line 2—2 of FIG. 1.
Figure 3:
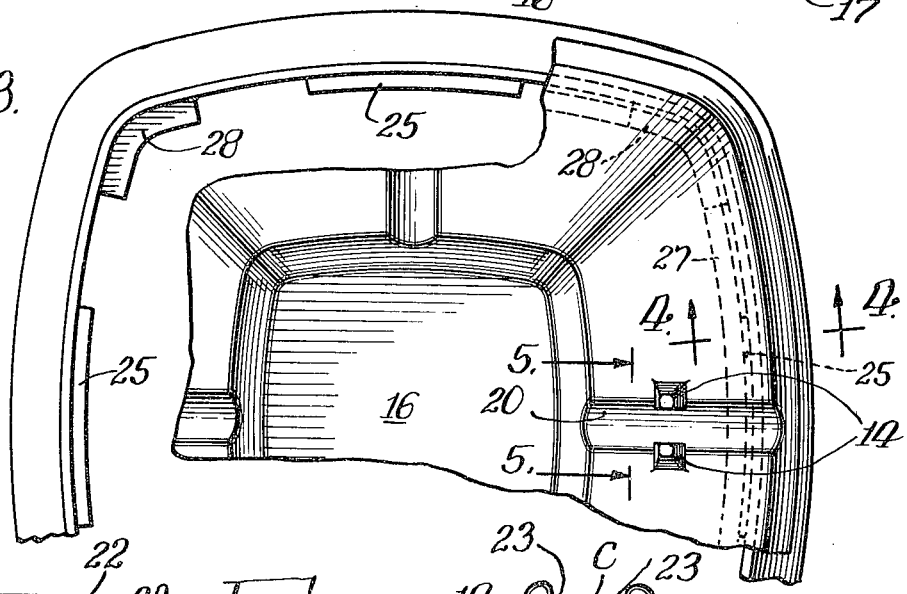
FIG. 3 is a fragmentary top plan view with portions broken away to facilitate illustration of the construction of the ashtray elements.

More specifically, as shown in FIG. 1, top portion 12 includes a plurality of pincer means generally designated 14 for compressibly retaining an inserted portion of the tobacco product, such as cigarette C, with the burning ash portion A overlying a central well 15. As shown in FIG. 2, the bottom wall 16 of well 15 is spaced above the lower edge 17 of the base portion 11 to provide an air space 18 below the top portion 12 thereby effectively precluding heat damage to the subjacent supporting surface S.

Figure 5:
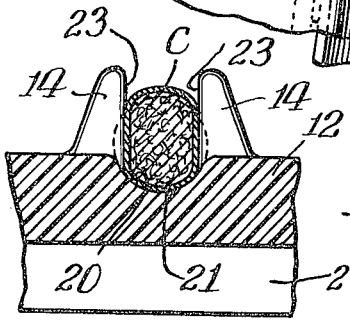
FIG. 5 is a fragmentary enlarged vertical section taken substantially along the line 5—5 of FIG. 3.

Extending outwardly from well 15, top portion 12 defines an upper surface 19 provided with a plurality of upwardly opening, segmentally cylindrical channels 20. Pincers 14 comprise pairs of upstanding lugs disposed one each at opposite sides of the channels for compressibly retaining the cigarette, as shown in FIG. 5, with the lower portion 21 of the cigarette urged against the top wall 12 in the channel 20 to provide an effective snuffing action when the burning ash portion A reaches the surface 19. Thus, in the preferred form, the lugs 14 are spaced apart a distance less than the normal diameter of the cigarette C to provide an effectively positive gripping of the cigarette with the ash portion A disposed over the well 15 for receiving the fallen ashes.

Wall surface 19 is preferably angled downwardly from the outer periphery 22 of top wall 12 toward the well 15, as best seen in FIG. 2. Thus, as shown, the burning ash portion A is effectively disposed within the well 15 when the cigarette is temporarily placed in the ashtray between the pincer lugs 14.

As the lugs provide a positive gripping of the cigarette, the burning portion A may be effectively maintained against the surface of the channels 20. It has been found that by providing such positive engagement therebetween, an improved snuffing action is effected normally snuffing the cigarette before the ash portion A reaches the pincers 14. In the event, however, that the burning portion is not so extinguished, such as where the cigarette is not urged fully downwardly between the pincer lugs to engage surface 21 thereof with the channel surface, the pincers themselves serve as an effectively positive snuffing means tending to extinguish the burning portion before it passes sufficiently through the lugs to permit freeing of the cigarette from the pincer means.

Thus, the pincer means 14 effectively functions to prevent falling of the cigarette over the outer periphery 22 of the top wall 12 with the burning portion A remaining lighted.

Further, from time to time, the user may carry the ashtray with the cigarette retained thereon without falling of the cigarette from the ashtray as a result of the transporting motion.

While the cigarette is effectively positively retained by the pincer means, it may readily be withdrawn therefrom by a simple upward movement by the user's fingers grasping the portion thereof outwardly of the pincers.

Referring to FIG. 5, the pincer lugs 14 may be seen to define confronting planar surfaces 23 for gripping the cigarette C therebetween. The lugs may have a height preselected to extend above the level of the bottom of the channel a distance greater than the diameter of the normal cigarette. The length of the channel outwardly of the pincer lugs 14, as illustrated in FIG. 2, may be equal to the length of the channel inwardly thereof. In the illustrated embodiment, the top portion 12 is formed of a melamine urea plastic. The base portion illustratively may be formed of a thermoplastic synthetic resin, such as polyethylene, polypropylene, nylon, acrylonitrile-butadienestyrene copolymer (ABS), etc. The length of the channels, in the illustrated embodiment, is approximately 1¼ inches.

Figure 4:
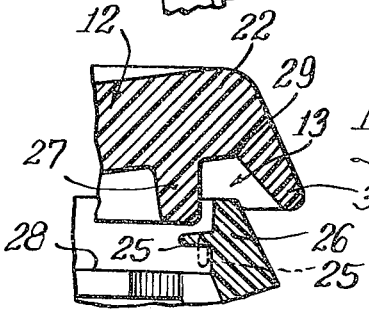
FIG. 4 is a fragmentary enlarged vertical section taken substantially along the line 4—4 of FIG. 3.

As indicated above, the base portion 11 is preferably separably secured to the top portion by the securing means 13. Thus, top portion 12 may be utilized with any one of a plurality of different base portions which may have different indicia 24 as desired. In the illustrated embodiment, the securing means comprises a plurality of inwardly projecting flanges 25 projecting inwardly from adjacent the upper end 26 of the base 11 a distance substantially greater than the thickness of the flanges. Top portion 12 is provided with a wedge portion 27 which, as shown in FIG. 4, may be moved downwardly within the upper portion 26 of the base portion 11 to deflect the wedging flanges 25 from the full line position of FIG. 4 to the dotted line position thereof wherein the flanges are wedged tightly between the base top portion 26 and the top wall wedging portion 27. Downward movement of the top portion 12 may be limited by engagement of the wedge portions 27 with stop shoulders 28 and by the engagement of undersurface 29 of the peripheral portion 22 of the top portion with the upper end 26 of the base portion to provide a positive support of the top portion 12 on the base portion 11, as shown in FIG. 2.

Where the base portion 11 is formed of a relatively rigid material such as polystyrene, the wedging means 25 may comprise separate wedge elements adapted to be compressibly received in the space between the ashtray portions 26 and 27.

As best seen in FIGS. 2 and 4, the peripheral portion 22 of the top wall 12 may define a depending outer flange 30 protectively overlying the upper end 26 of base portion 11.

The base and top wall portions of the ashtray may be molded to provide economical construction thereof with the pincer lugs 14 being molded integrally in the top wall 12 to provide an accurate spaced relationship therebetween as discussed above.

The foregoing disclosure of specific embodiments is illustrative of the broad inventive concepts comprehended by the invention.

I claim:

1. A safety ashtray comprising:

cup-shaped wall means integrally defining a well for receiving ashes from a conventional cigarette, an outer periphery, and a segmentally cylindrical upwardly opening channel for receiving the lower longitudinal extending segmentally cylindrical portion of the cigarette with a lighted end thereof overlying said well;

pincer means integrally upstanding from said wall at opposite sides of said channel and spaced substantially equidistantly outwardly from said well and inwardly from said outer periphery for compressively retaining an inserted portion of the cigarette to retain the portion of the cigarette between said pincer means and well on said wall means in said channel for causing extinguishing of the burning portion as it contacts said wall means in the channel and for providing an effectively positive snuffing action on the burning portion in the event it is not extinguished by said contact with the wall means in the channel before reaching said pincer means; and a base portion removably secured to said wall means outwardly of said pincer means and formed of a relatively soft plastic material for effectively wall scratching and similar deformation of a surface on which the ashtray may be set.

2. The safety ashtray of claim 1 wherein said pincer means comprises a pair of opposed lugs.

3. The safety ashtray of claim 1 wherein said pincer means comprises a pair of opposed lugs, said channel and lugs cumulatively having a height preselected to cause the lugs to extend above the level of the bottom of said channel therebetween a distance greater than the diameter of the cigarette.

4. The safety ashtray of claim 1 wherein said channel is inclined downwardly toward said well.

5. The safety ashtray of claim 1 wherein said wall means is formed of a thermoset plastic.

6. The safety ashtray of claim 1 wherein said base portion comprises a thermoplastic molding.

7. The safety ashtray of claim 1 wherein cooperating wedge means are provided on said wall means and base portion for removably wedging said wal means ad base portion together.

8. The safety ashtray of claim 1 wherein cooperating wedge means are provided on said wall means and base portion for removably wedging said wall means and base portion together, said wedge means including a flange formed integrally with one of said wall means and base portion elements projecting toward the other thereof and arranged to be deflected into wedged relationship therebetween when the wall means and base portion elements are brought together.

9. The safety ashtray of claim 1 wherein cooperating wedge means are provided on said wall means and base portion for removably wedging said wall means and base portion together, said wedge means including a substantially rigid flange on one of said wall means and base portion elements and a deflectible flange on the other of said elements projecting toward the rigid flange and in wedged relationship therewith.

10. The safety ashtray of claim 1 wherein said wall means defines a downwardly opening peripheral channel and said base portion includes upper wedge means wedgedly received in said peripheral channel.

11. The safety ashtray of claim 1 wherein said wall means defines a downwardly opening peripheral channel and said base portion includes upper wedge means wedgedly received in said peripheral channel defined by a deflectible projection integral with the base portion.

12. An ashtray comprising:

a base portion formed of a thermoplastic material;

a top portion defining a well for receiving ashes formed of a thermoset plastic material;

deflectible wedge means formed unitarily on one of said portions and engageable by the other of said portions to be deflected into wedged relationship therebetween for securing the top portion to an upper edge of the base portion of the ashtray; and means on said top portion for holding a cigarette including means for effectively positively snuffing the held cigarette at a preselected distance inwardly of said upper edge of the base portion whereby heat from the burning cigarette is effectively prevented from damaging the thermoplastic base portion.

13. The ashtray of claim 12 wherein the deflectible means is formed unitarily with said base portion.

* * * * *